US005881760A

United States Patent [19]

Del Zotto

[11] Patent Number: 5,881,760

[45] Date of Patent: Mar. 16, 1999

[54] MODULAR STEEL TANK WITH CASTING WALL

[76] Inventor: William M. Del Zotto, 2300 Commonwealth Ave., Duluth, Minn. 55805-1699

[21] Appl. No.: 716,747

[22] Filed: Sep. 23, 1996

[51] Int. Cl.[6] ..... B65D 88/76

[52] U.S. Cl. ..... 137/264; 137/312; 220/445; 220/410; 220/571

[58] Field of Search ..... 137/264, 312; 220/501, 469, 445, 447, 404, 410, 571

[56] References Cited

U.S. PATENT DOCUMENTS

| | | | |
|---|---|---|---|
| 5,071,166 | 12/1991 | Marino | 220/571 X |
| 5,299,709 | 4/1994 | Beerbower et al. | 220/445 |
| 5,454,544 | 10/1995 | Del Zotto | 249/83 |
| 5,582,310 | 12/1996 | Del Zotto | 220/445 X |
| 5,769,109 | 6/1998 | Stanton et al. | 137/264 |

*Primary Examiner*—Kevin Lee
*Attorney, Agent, or Firm*—D. L. Tschida

[57] ABSTRACT

A metal or fiberglass, liquid storage tank having a top wall or an auxiliary flange plate which projects beyond the tank side and end walls to support the tank to a base vault and provide a support surface for a cover which is cast in place to the tank. The primary tank is mounted within an open-topped, reinforced cast concrete base which includes an internal thermal liner, liquid impermeable membrane, cover seals, tank cradles and support legs which define secondary and tertiary containment spaces. Sloped interior walls direct liquid and/or condensation to a sump region and a siphon assembly. The cover is integrally bonded to the tank and supports a number of projecting fill, vent, extraction, inspection, and monitor/siphon standpipes. Chamfered and interlocking surfaces are formed at the cover to base joint and lift eyes facilitate cover and tank removal, alignment, and tank inspection. A spill containment collar mounts about the fill pipe and a drain pipe and overflow pipe direct spillage to the tank or a secondary storage space in the base.

24 Claims, 6 Drawing Sheets

MODULAR STEEL TANK WITH CASTING WALL

BACKGROUND OF THE INVENTION

The present invention relates to an above-grade multi-section cast concrete containment vessel which includes a primary liquid storage tank and intervening liquid and thermal liners, which collectively define primary, secondary and tertiary storage spaces, and, in particular, to an improved metal storage tank having a wall section or auxiliary flange plate which facilitates casting a cover to the tank to form a unitary assembly and mounting the tank to a base storage container.

A byproduct of society's increasing awareness to the environment and growing concerns over ground water contamination and the adverse effects of spilled petrochemicals (e.g. oil, gasoline etc.) has been the institution of varieties of regulatory controls. A predecessor containment tank to the present invention was developed to accommodate such regulations, especially for circumstances requiring above-grade storage of gasoline, and the containment of spills from accidental overfilling and tank ruptures. A further purpose was to accommodate concerns of the user to the cost and repair or replacement of portions of the containment system.

A variety of below-grade storage systems have been developed for containing pressurized and non-pressurized, flammable liquids, such as gasoline, propane or natural gas. Some of such containment vessels or tanks are shown at U.S. Pat. Nos. 1,958,487; 3,151, 416; 3,995,472; 4,183,221; 4,607,522; and 4,653,312. The foregoing vessels generally provide tank constructions which include a primary metal containment chamber that is surrounded by a reinforcing material, such as concrete. Intervening layers of thermal insulators and/or liquid impermeable materials are also disclosed in the various liquid storage assemblies.

Numerous above-grade storage vessels are also known. Most such vessels provide only a tank assembly having a single skin or layer of material, such as metal, concrete or fiberglass, which can be damaged and produce an uncontained spill.

To avoid spills, some tanks are diked behind a surrounding berm. Some tanks provide a multi-layered construction that includes a primary tank surrounded by a concrete or metal structure. The primary tank may or may not be integrated into the surrounding structure. U.S. Pat. Nos. 2,083,491; 2,136,390; 2,777,295; and 4,513,550 disclose cast concrete containment chambers wherein the structural walls include liquid impermeable liners.

Still other above-grade storage vessels are disclosed at U.S. Pat. Nos. 2,544,828; 3,562,977; 4,366,654; 4,372,906; 4,552,166; 4,826,644; 4,934,122; and 4,986,436. Various of the foregoing storage vessels provide a primary metal containment chamber which is surrounded by a monolithic cast concrete vault. One or more intervening membranes impermeable to a contained liquid are also provided.

Other diked metal storage tanks having secondary containment are shown at U.S. Pat. Nos. 4,895,272 and 5,346,093. Also disclosed at the tanks are an assemblies for directing spillage from the vent into a secondary storage space.

A principal deficiency of the foregoing above-grade storage containers is that the primary tank is exposed to a variety of physical dangers which can affect the life of the container. The sealed concrete tanks are also subject to potential cracking with the differential properties of thermal expansion and contraction of the materials; physical damage due to handling or collision from automobiles, trucks, on-site equipment or the like; and potential corrosion of reinforcement members within the concrete, such as from condensates which form between the steel liner and surrounding concrete assembly. Damage to any one of the container components typically requires replacement of the entire assembly.

In preference to a monolithic assembly, a modular assembly permits selective replacement of one or more of the container components in the event of damage or normal wear and tear to the individual components. A modular construction is also more accommodating of conventional manufacturing processes, such as are used to form open top septic tanks and detachable covers. Examples of a tank and a form used to cast tanks having integral covers and storage tanks which mount within a concrete base container are shown at U.S. Pat. Nos. 5,285,914 and 5,454,544.

Appreciating the latter secondary storage tanks are capable of storing volumes from 250 to 10,000 gallons, the physical sizes can produce difficulties in manufacture. A particular concern is the assurance of a proper alignment of the primary storage tank to the cover and ultimately the combined cover and tank to the base container. The casting form of the U.S. Pat. No. 5,454,544 patent assures proper alignment of the cover to the tank, however, the time and logistics to prepare the form and the necessity of having to own multiple forms for different sized tanks can be economically costly.

The present invention therefore provides an improved primary metal liquid storage container, which lends itself to conventional pre-cast concrete construction technology. The tank provides an improved construction with end walls which are shaped to align and center the tank within the base container. A flat top wall extends beyond roll formed or welded side and bottom wall panels and provides a platform or floor which supports the cover concrete during curing and which is cast into the cover. Fiberglass primary tanks can also be adapted to the invention. Tanks fitted with auxiliary casting flange plates are also shown which permits the use of the invention with conventional round steel and fiberglass tanks. Such tanks can be retrofit with an appropriate auxiliary flat flange to accommodate the casting in place of a cover that integrally includes the primary tank.

SUMMARY OF THE INVENTION

It accordingly is a primary object of the present invention to provide a multi-chambered liquid storage assembly having a primary liquid containment tank that includes at least one wall or an auxiliary flange plate fitted to the tank which supports the concrete used to cast an integral cover to the primary tank and whereby the cover and primary tank align to a concrete base container and the primary tank is permanently secured to the cover.

It is a further object of the invention to provide a primary tank having a top wall or an auxiliary flange plate which aligns to the open top of a base container and to perimeter casting forms to support the concrete during the casting of the concrete cover, which cover is cast in place to the primary tank and in alignment to the base container.

It is a further object of the invention to provide a primary tank wherein a number of standpipes project from a flat wall or auxiliary flange plate secured to the tank.

It is a further object of the invention to provide a primary tank having end walls which project beyond the side and bottom walls of the primary tank to center and elevate the tank at the base container.

It is a further object of the invention to provide a storage assembly having a spill containment chamber which mounts about fill and/or vent pipes that extend from the primary tank to collect spillage and direct any spillage to a secondary storage space within the base container or to an auxiliary container.

Various of the foregoing objects, advantages and distinctions of the invention are obtained in a presently preferred construction which provides an open-topped, reinforced cast concrete base container and a removable, separately cast cover and primary tank assembly. The cover supports an integrally cast, primary, metal or fiberglass liquid storage tank. The primary tank includes a top wall or flange plate which projects to span and align to the side walls of the base container and cover the base during the casting in place of the base cover to the primary tank.

The base container and cover are lined with a thermal barrier. The thermal barrier of the base is separately covered with a liquid impermeable membrane. A sump region at a low point of the base and a siphon assembly are provided which communicate with the interior spaces between the tank and liner and the liner and base. End walls at the primary tank project beyond the primary tank side walls to align and center the primary tank and cover to the base and assure desired clearances between the primary tank and base container. The side walls in combination with intermediate cradles also elevate the primary tank above the bottom of the base container.

The cover is integrally cast to common reinforcement members which project from the flat top wall of the primary storage tank. The top wall of the tank aligns to perimeter casting forms which define the side walls of the cover and which forms fit to the base and tank top to permit casting the cover in place, once the primary tank is aligned to the base container. Chamfered cover edges and lifting eyelets, which are secured to the tank and project from the cover, facilitate removal or replacement of the tank and cover. The base, cover and/or primary tank are thereby separately replaceable.

A seal mounts between the base and cover. Separate resilient seals are cast into the cover to surround a number of standpipes which project from the primary tank or communicate with the secondary and tertiary storage spaces. Ones of the standpipes permit filling and vent the primary tank. Others permit monitoring the stored liquid and inspection of the secondary and tertiary spaces.

The interior walls of the base are sloped to relieve stresses encountered in climates exposed to potential freezing conditions and direct collected leakage, spillage or condensate to the sump space. Siphon assemblies remove condensate, leakage or spillage. Support legs extend from the base to facilitate vault handling. Skirts may be mounted to the vault legs, once the container is located at the storage site.

A spill collar is fitted around the fill pipe and/or vent pipe to collect spillage that may occur during filling or with liquid expansion. The collar can be integrally cast with the cover. A hinged cover mounts to the housing. Conduits direct collected spillage to the secondary or tertiary containment space within the base container or to an auxiliary container displaced from the base container.

Also disclosed are auxiliary flange plates which can be retrofit to conventional metal and fiberglass tanks. The flange plates can be constructed as flat plates with appropriate cutouts to mate with the primary tank. Alternatively, brackets may be formed and fitted to the tank to support the tank at a base container. As necessary, a flat cover piece may be mounted over the brackets.

Still other objects, advantages and distinctions of the invention will become more apparent upon reference to the following detailed description with respect to the appended drawings. To the extent various modifications and improvements have been considered, they are described as appropriate. The invention should not be interpreted in strict limitation to the provided description. Rather, the invention should be interpreted within the spirit and scope of the appended claims.

BRIEF DESCRIPTION OF THE DRAWINGS

In the drawings, like element designations refer to like parts throughout, and.

DESCRIPTION OF THE PREFERRED EMBODIMENT

Figure 1:
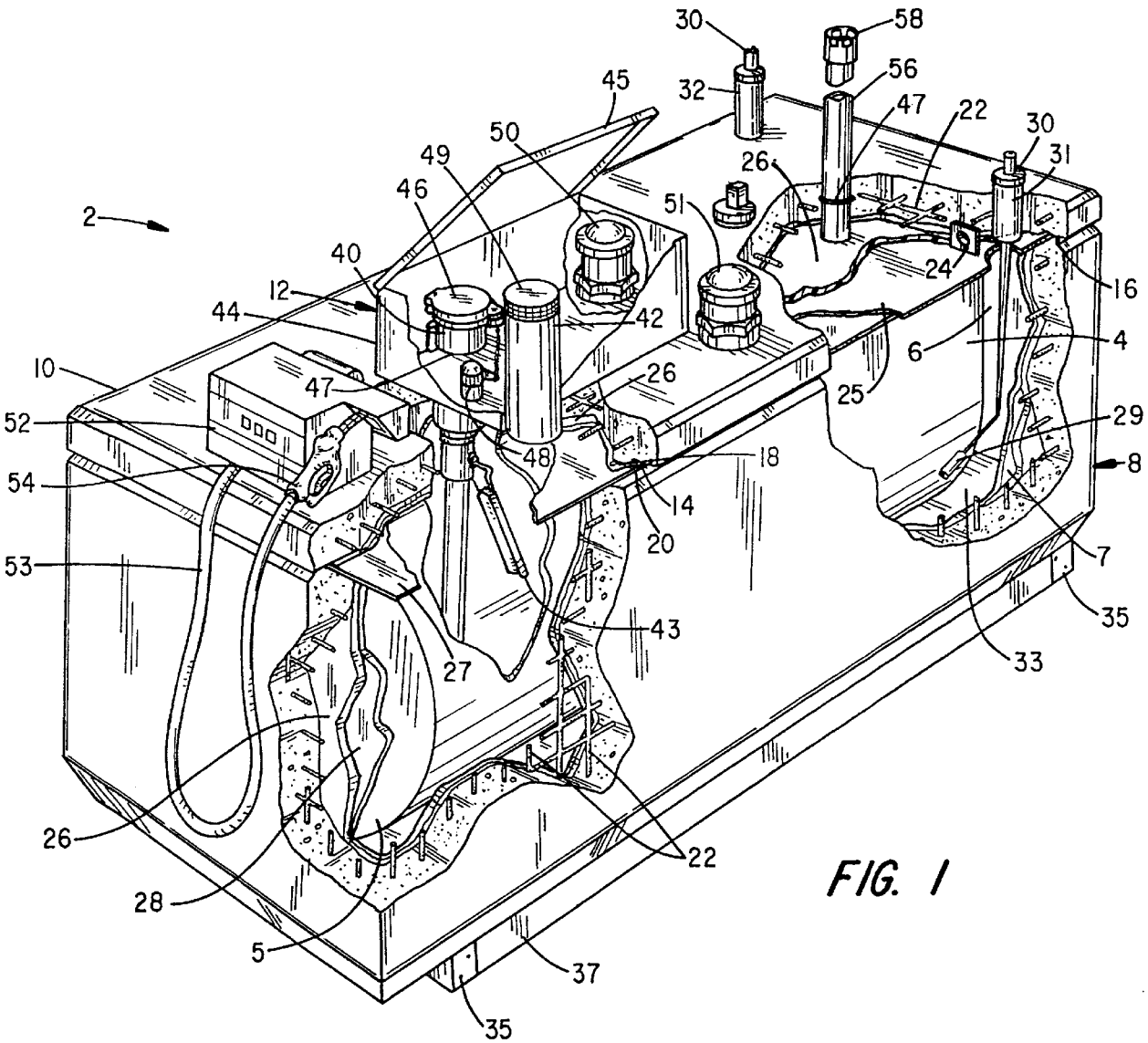
FIG. 1 is a perspective drawing shown in partial cutaway to a vault wherein primary storage tanks of alternative construction are fitted to a base container and having an overflow or spill containment collar at the tank.

Referring to FIG. 1, a perspective drawing is shown to a multi-section, liquid storage container or vault 2 which includes a primary containment tank 4 having a flat top wall 25. Secondary and tertiary containment of leaks, spills or condensation is obtained in cavity spaces 6 and 7 between the tanks 4 or 5 and the walls of a surrounding cast concrete vault or base container 8.

An exemplary, round walled primary tank 5 is also shown with a retrofitted auxiliary flange plate 27 secured to the tank 5 and which tank can be used in lieu of the tank 4. Except as specifically discussed below to the tank 5, it is to be appreciated all references hereafter to the tank 4 apply equally to the tank 5 and flange plate 27, which combination can be substituted for the tank 4.

The base container 8 provides an open top which is covered with a cover 10. The base 8 is sized to contain a volume of approximately 120% to 150% of the volume of primary tank 4. Presently, the base 8 is sized to contain 125% of the storage capacity of the primary tank 4. The secondary storage space 6 collects and contains leakage that might occur from a rupture of the primary tank 4 or condensation that might collect on the tank 4. Although a homogeneous cast concrete base 8 is shown, the base 8 might also be constructed of a number of laid blocks or a variety of other materials.

Spillage, which can result from over filling the tank 4 or from thermal expansion of the contained liquid, is also collected and contained by the secondary space 6. A spill collar 12 directs any such spillage to the secondary space 6. Spill containment is possible due to the excess storage capacity provided by the base 8. The secondary space 6 is redundantly protected by the tertiary containment space 7, which is formed between the walls of the base 8 and a liquid impermeable liner 28 that is discussed below.

The cover 10 is sealed to the upper peripheral edge of the side and end walls of the base 8 with a resilient, compressible fire stop barrier material 14 and sealant 16. Mating flanged surfaces 18 and 20 are formed into the cover 10 and base 8 to overlap and align with one another and interlock the cover 10 to the base 8. The mechanical integrity and retention of the cover 10 to the vault 2 is thereby preserved in the event lateral forces are directed against the base 8, such as from a vehicle striking the base 8.

Figure 2:
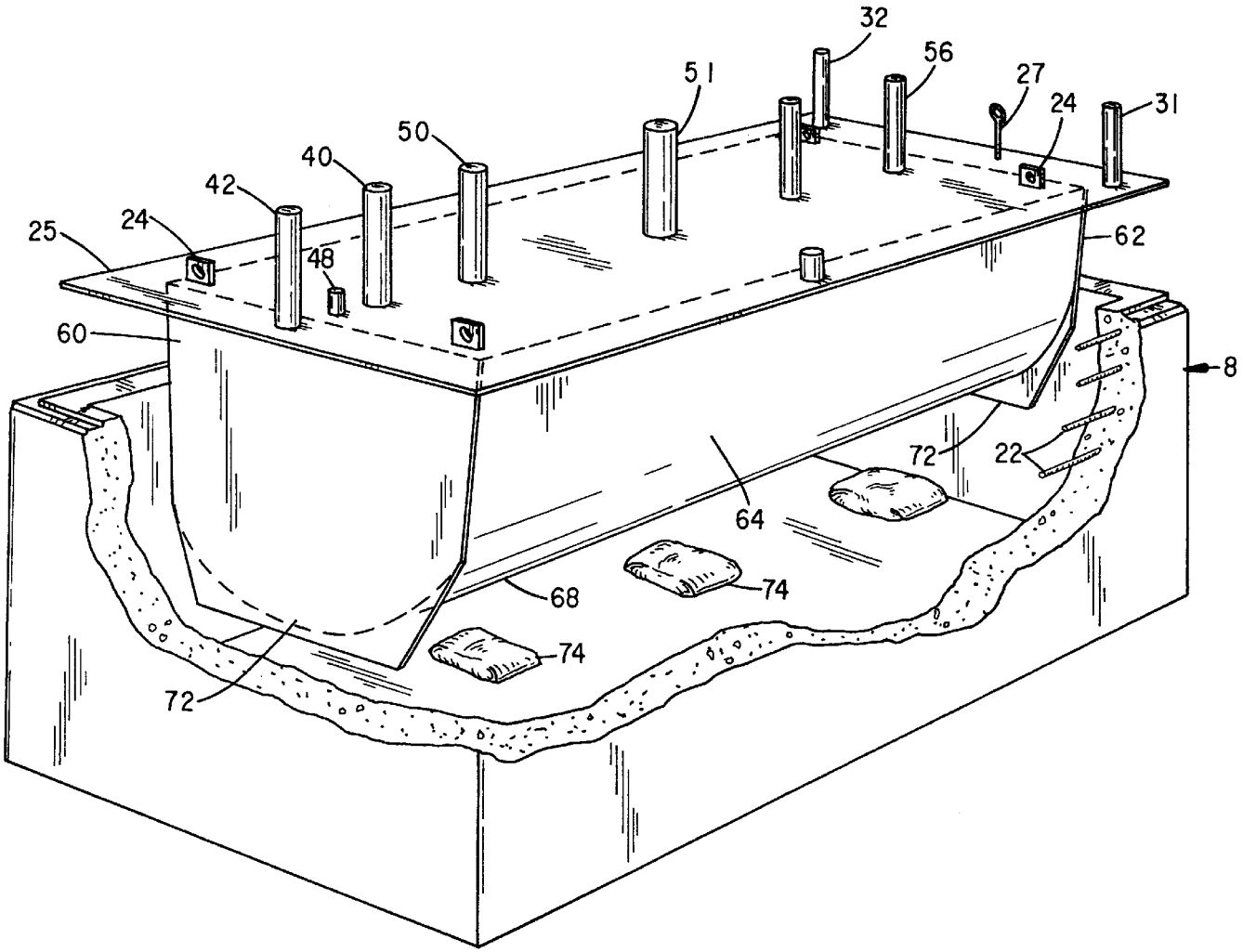
FIG. 2 is a perspective drawing showing a primary tank having a flat top wall partially removed from the base container which is shown in cutaway.

Cast into the walls of the base 8 and cover 10 in conventional fashion are reinforcement members 22, which typically comprise lengths of rebar, wire mesh or the like. The reinforcement members 22 at the cover 10 are woven and interconnected to the bores of weldments 24 which extend from a flat top wall 25 of the primary tank 4. A variety of projections or apertured interconnections, which don't conflict with the integrity of the tank 4, can be used to equal advantage as attachment couplers for the members 22. Lifting eyelets 27, reference FIG. 2, may also extend from the top wall 25 to facilitate movement of the tank 4. With the casting of the cover 10 in place and in alignment with the base 8, the cover 10 and primary tank 4 become bonded together as a single assembly. Details to the casting process are described below at FIGS. 2 through 4.

The primary storage tank 4 is preferably constructed of metal although might be constructed of fiberglass or other materials which permit the forming of a flat top 25 at the tank 4 or 5. The top wall 25 should be constructed to withstand the working pressures and conditions of the tank 4 as well as the stress and weight of the concrete used to cast the cover 10. The top 25 should also include fasteners 24 that permit interconnection with the reinforcing members The top wall 25 is sized to span the open top of the base container 8 and align with the surface 20. With the top 25 fitted to the base 8, proper alignment of the tank 4 is obtained, prior to casting the top 25 into the cover 10.

The advantages of the flat top tank 4 are also obtained at the round walled tank 5 by fitting the auxiliary, flat, flange plate 27 to the tank 5. The plate 27 is sized to span the top of the base 8 and to support the concrete used to form the cover 10 during curing. The plate 27 is formed to accommodate any necessary standpipe or access openings, the weldments 24 and the collar 12. As necessary, a series of braces of cross pieces can be fitted to the plate 27 to enhance the rigidity of the plate material. The cross braces can span the base 8 or not as desired. The cross braces may also be constructed to interconnect with the reinforcement members 22.

Figure 6:
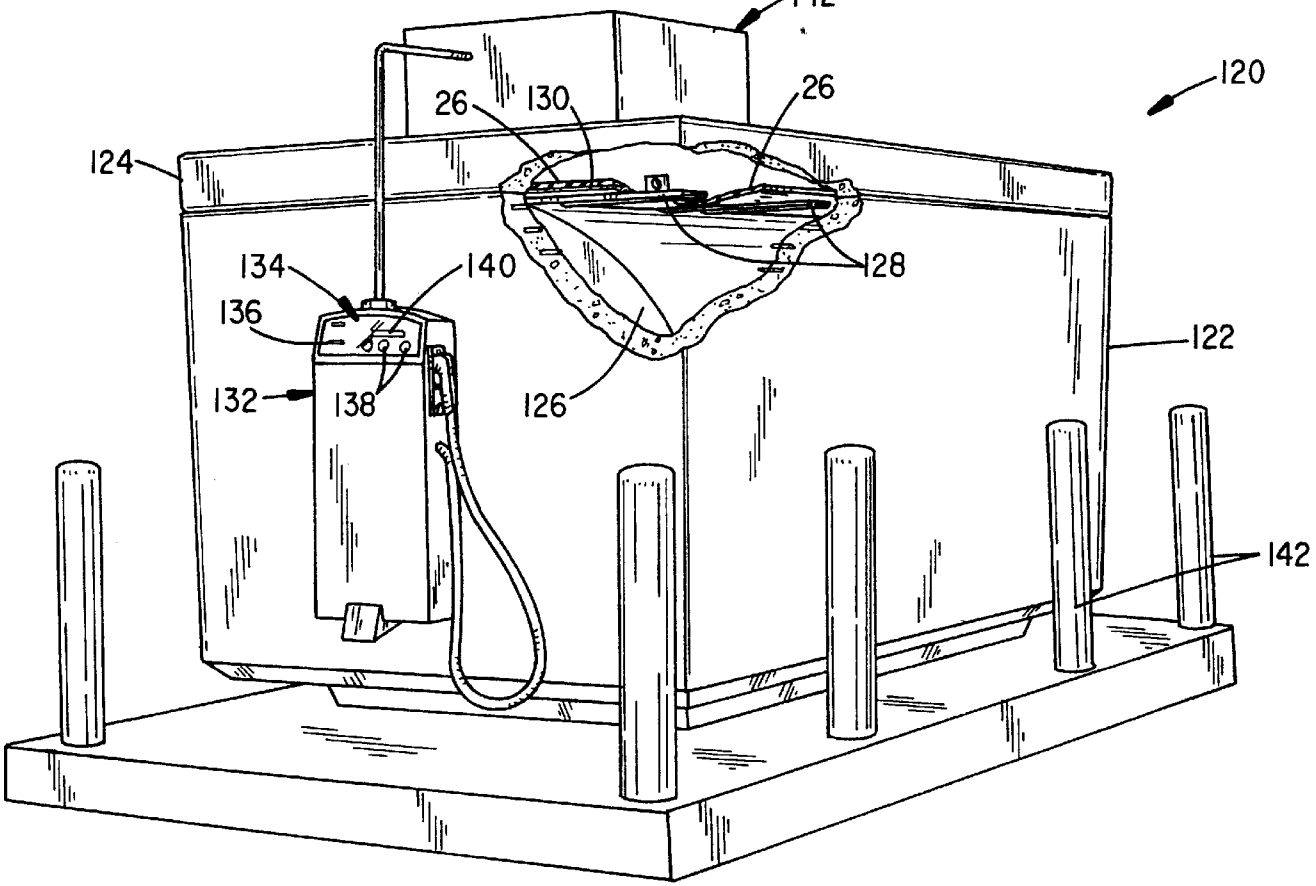
FIG. 6 is a view of a vault having a side mount fuel dispenser and wherein an auxiliary flange constructed of a number of brackets and cover plate are fitted to the primary tank and supported to the base container.

Although a flat flange plate 27 is shown, the plate 27 might comprise a number of brackets which project from the tank 5 to support the tank 5 to the base 8 and which are covered over with a material capable of supporting the cover concrete, reference FIG. 6. Alternatively a series of brackets (e.g. flat brackets which are covered with a flat material; covered right angled brackets; or bent lengths of sheet material which overlap and cover the base opening) might be secured to the tank 5 and mounted to the base 8 to cover the base 8 and contain the cover concrete during curing.

Mounted to the interior surfaces of the container 2 is a thermal insulator or liner 26. Sheets of foam are presently bonded with a suitable adhesive to the concrete walls and floor of the base 8 and to the upper surface of the top plate 25. The thermal barrier 26 reduces potential moisture and condensation which can occur within the base 8. covering the thermal barrier 26 is a continuous layer of a liquid impermeable sheathing 28 which is folded to closely fit to the foam liner 26 and extend over the upper edges of the base 8 and beneath the fire stop 14. The sheathing 28 is bonded to the upper edges of the base 8 with an adhesive sealant 16 that is impervious to any stored liquids (e.g. PENSIL 300). The sheathing 28 defines the interface between the secondary and tertiary storage spaces 6 and 7.

Figure 3:
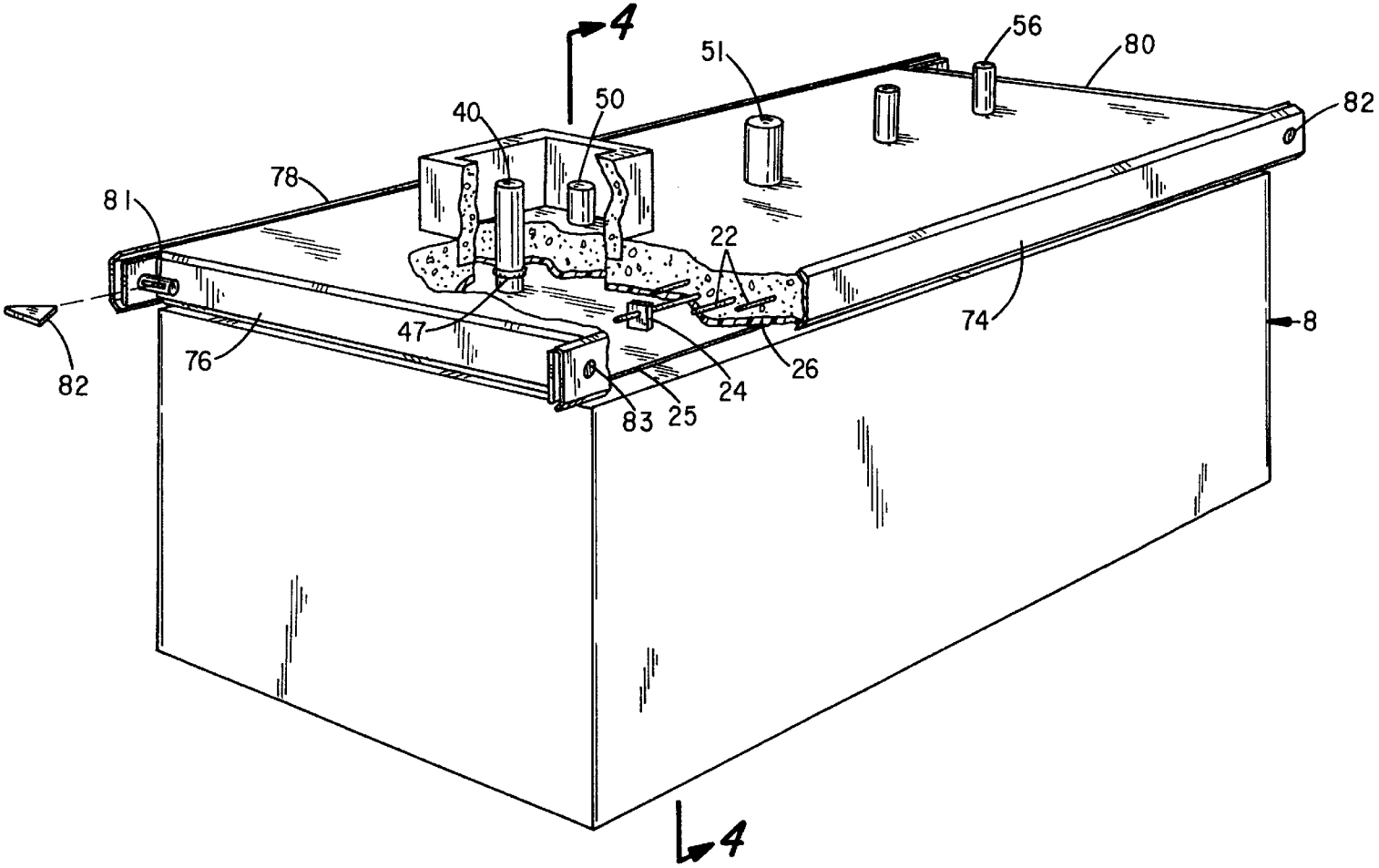
FIG. 3 is a perspective drawing shown in partial cutaway through the cover and perimeter casting form walls which are fitted to the tank's top wall and which casting forms define the base.
Figure 4:
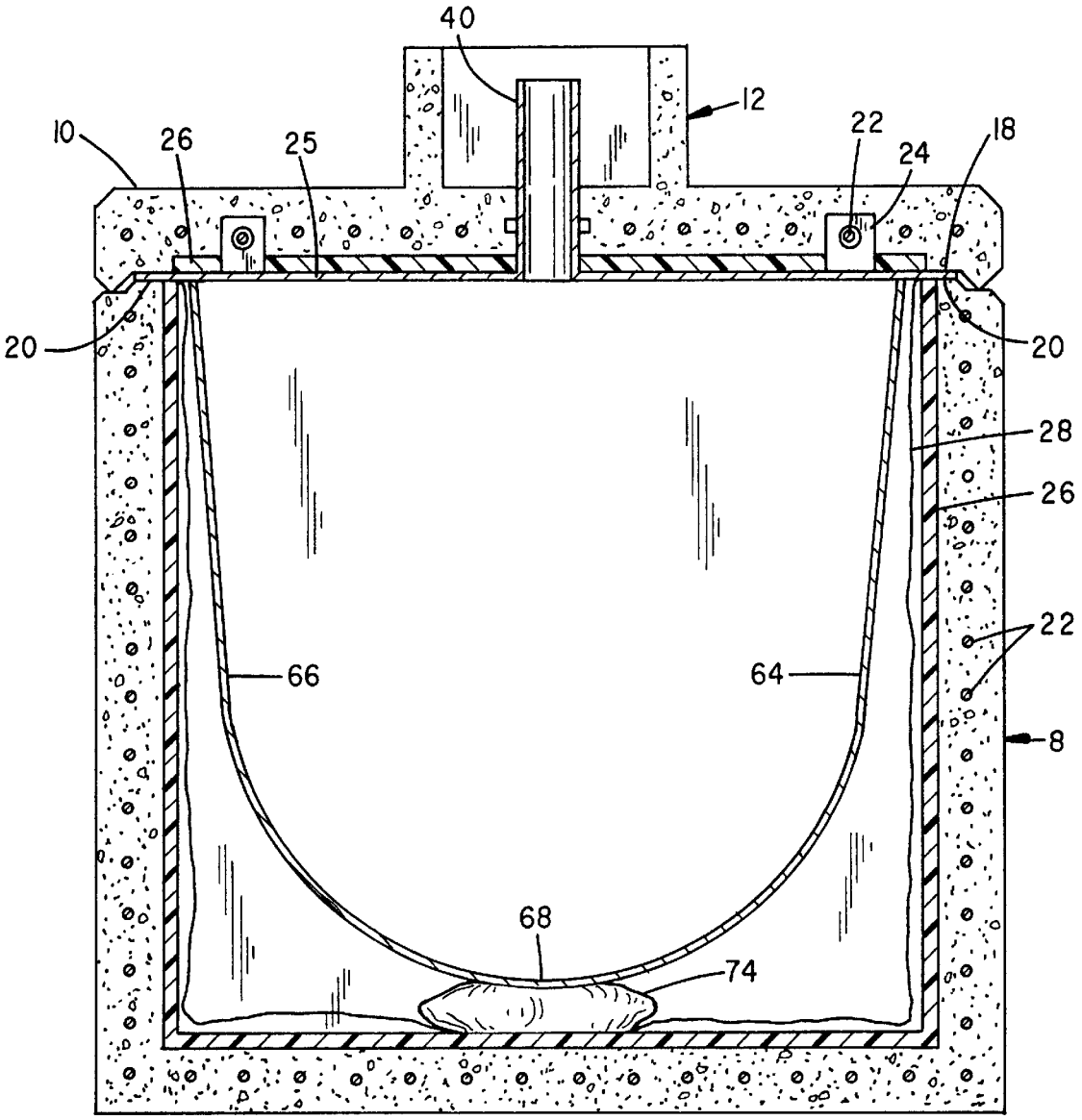
FIG. 4 is a cross section view through the tank of FIG. 3 taken along section lines 4—4.

Bonded, in turn, to the upper surface of the sheathing 28 is the fire stop 14. A bead of sealant 16 is applied to the barrier 14 prior to fitting the top wall 25 and tank 4 to the base 8. Once the top wall 25 is fitted to the base 8, perimeter casting forms 74–80, reference FIG. 3, are mounted and supported to the wall 25 and base 8 and the cover 10 is cast in place. The details to the casting operation are described below with respect to FIG. 3.

In the event of a rupture of the primary tank 4, spilled liquid is normally retained within the base 8 at the secondary containment space 6 between the tank 4 and liner 28. In the event of a rupture of the liner 28, the spillage is captured by the walls of the base 8 in the tertiary containment space 7. The tank 2 may also be bermed behind surrounding earthen walls or be buried in a partial or complete below-grade trench to provide additional spill collection capabilities. An auxiliary tank (not shown) may be coupled to the tank 2 to collect leaks or spills.

A conventional leak monitoring assembly 30 projects from the cover 10 at a standpipe 31 that extends into the secondary space 6 to monitor possible leaks or spillage as discussed below. Similarly, a monitor 30 is fitted to a standpipe 32 to monitor liquid in the tertiary space 7 between the liner 28 and walls of the base 4. A float 29 is presently coupled to the monitor 30 at the stand pipe 31. A variety of conventional monitoring assemblies, however, can be used to monitor for liquids at the pipes 31 and 32 and which may include a variety of liquid sensing transducers. A single monitoring assembly 30 can also be used, or none, depending upon the application and regulatory requirements.

The stand pipes 31 and 32 may also be simply used as visual inspection ports. That is, an operator can periodically illuminate and look into the interior of the base 8 from the pipes 31, 32. A simple dipstick (not shown) may also be inserted through either of the pipes 31, 32 to monitor for the presence of liquid.

A sump region 33 or low point of the bottom wall is formed in the region beneath the pipes 31 and 32 to collect leakage and spillage. The bottom wall of the base 8 is preferably sloped to direct liquid to the sump 33. A conventional siphon or pump assembly may also be fitted in conventional fashion to either of the pipes 31, 32 as required to extract liquids that collect in the spaces 6 and 7.

Legs 35 support the base 8 above the ground and permit the lifting of the vault 2 with a crane and a cradle or straps mounted beneath the vault 2 and or other appropriate equipment. Once set to a preferred site, the legs 35 are enclosed by skirts 37. Debris and other materials are thereby prevented from collecting beneath the base 8.

The spill collar 12 equips the vault 2 to contain possible spillage which might occur during the filling of the tank 4. Spillage can occur under either "loose fill" or "tight fill" conditions. A "loose fill" condition exists where a fill nozzle is loosely supported (i.e. not threaded) to the fill pipe 40. A "tight fill" condition exits where the fill nozzle is threaded to the fill pipe 40.

Mounted within the spill collar 12 is the fill pipe 40 and an overflow pipe 42. The pipes 40 and 42 are contained by an overflow housing 44, which has a loose fitting cover 45. The housing 44 can be constructed of metal, although may also be formed from cast concrete. The housing 44 is sized to contain 5 to 25 gallons.

A conventional overspill cover 46 is mounted to the fill pipe 40. Also contained within the housing 44 is a drain valve 48 which is coupled to the fill pipe 40. A check valve 43 is separately fitted to the fill pipe 40 and prevents back flow from the tank through the fill pipe 40. Some tanks 4 may not include a check valve 43.

Resilient seals 47 and/or caulking are mounted between the housing 44 and the pipes 40, 42 and 46, where the housing 44 is metal, to contain any overflow or spillage to the housing 44 and direct the overflow through an open mesh cover 49 at the overflow pipe 42. Alternatively, the resilient seals 47 are mounted between the standpipes and concrete in the cover 10, see also FIG. 3. The pipe 42 preferably opens to the secondary containment space 6. The pipe 42 might also open to the tertiary space 7 or communicate with an auxiliary storage space or tank.

Under nominal overflow conditions, overflow or spillage, e.g. less than 2.5 gallons, is directed into the primary tank 4 from the fill pipe collar 46 or from the drain 48. Both capture and direct the liquid into the tank 4 via the fill pipe 40 or a bypass conduit that extends from the collar 46 and opens to the tank 4. If the volume of spillage or overflow exceeds the capacity of the tank 4, the additional liquid is directed to the secondary containment space 6 via the overflow pipe 42 and from which the spillage can be reclaimed. Overflow conditions can occur for a variety of reasons, for example, inattention of a fill operator or defective fill equipment.

Supported also to the cover 10 is a variety of auxiliary equipment and redundant systems to support the use and maintain the integrity of the vault 2. An emergency vent pipe 50, which vents the tank 4 and which is shown in cutaway, is mounted adjacent the overflow housing 44. An inspection manhole 51 permits inspection of the secondary space 6. A metered pump assembly 52 having a hose 53 and a dispensing nozzle 54 is fitted to an extraction pipe (not shown) that communicates with the interior of the tank 4. The pump assembly 52 may include capabilities to charge or debit access or charge cards and user accounts with appropriate charges for the dispensed fuel. A variety of metered dispensers of the latter type are known. A vent pipe 56 having a ball float, check valve 58 vents the tank 4.

Returning attention to the primary tank 4 and with attention to FIGS. 2 through 5, the tank 4 provides a flat top wall 25 which is welded to a pair of end walls 60 and 62, side walls 64 and 66, and bottom wall 68. The side walls 64, 66 are roll formed as a continuous piece with the bottom wall 68. The side and bottom walls can also be formed as separate panels which are welded together, reference FIG. 5. The gauge and type of metal or other tank material is selected as appropriate for the contained liquid and storage volume. Conventional tank construction practices are followed during the construction of the tank 4.

The top wall 25 is sized to overlap the side and bottom wall sections 64–68 and mount to the edges 20 of the base 8. The foam liner 26 is typically fitted over the top of the top wall 25. The bored weldments 24 extend from the top wall 25 along with the various standpipes 32, 40, 42, 51 and 50. The numbers and locations of the standpipes can be appropriately varied to accommodate the particular specifications of the vault 2.

The end walls 60 and 62 similarly project beyond the side walls 64 and 66 and are vertically tapered to align the tank 4 to the base as the tank 4 is lowered into the base 4. That is, the side walls 60, 62 at the top wall 25 closely approximate the width of the opening at the base 8 and desired side wall clearances and narrow at the bottom. Upon lowering the tank 4 into the base 8. The edges of the end walls 60 and 62 space the tank 4 away from the tank 4 into centered alignment with the base 8, as the tank 4 is lowered into the base 8. The end walls 60, 62 may exhibit alternative configurations.

Bottom edges 72 of the end walls 60, 62 are also displaced from the bottom wall 68 to elevate the bottom wall 68 from the bottom of the tank 4 in the fashion of a cradle. Additional complementary cradles 74, e.g. bags of cement, can be mounted beneath the end and bottom walls 60, 62 and 68 to further support the tank in a preferred level condition to the base 8. The tank 4 is thus supported by the top wall 25 to the edge surface 20 of the base 8 and at numerous points along the bottom wall 68 to prevent damage to the tank 4.

Referring to FIG. 3, with the centering of the tank 4 within the base 8 and the supporting of the to wall 25 to the edge surfaces 20, perimeter casting forms 74, 76, 78 and 80 are fitted to circumscribe the top wall 25. Slotted pins 81 and wedges 82 are secured to aligned through holes 83 at adjoining corners of the forms 74–80. The wedges 82 draw the forms to one another and securely retain the forms 74–80 to the top wall 25. The bottom edges of the casting forms 74–80 also rest on the chamfered edges of the side walls of the base 8 during casting. A casting table such as shown at U.S. Pat. No. 5,454,544 is therefore not required.

The forms 74–80 presently exhibit an edge profile, which defines chamfered surfaces at the exposed edges of the cover 10, and which provides support for the forms 74–80. For other types of edging between the cover 10 and base 8, temporary supports might be fitted to the joint to support the forms 74–80 during casting.

Casting of the cover 10 proceeds with the filling of the fitted forms 74–80 with sufficient concrete to cover any liner 26 and fill the perimeter forms 74–80. With the stripping of the perimeter forms 74–80 and removal of any casting slag, the cover 10 is perfectly aligned to the base 8. The cover 10 is also sealed to the base 8 through the prior bedding of the plate 25 and setting of the tank 4 in the base 8. A simplified casting operation is thus achieved with the flat top wall 25, which forms a casting floor for the perimeter forms 74–80 and cover concrete during casting. The top wall 25 thus is cast into the cover just as the weldments 24.

Figure 5:
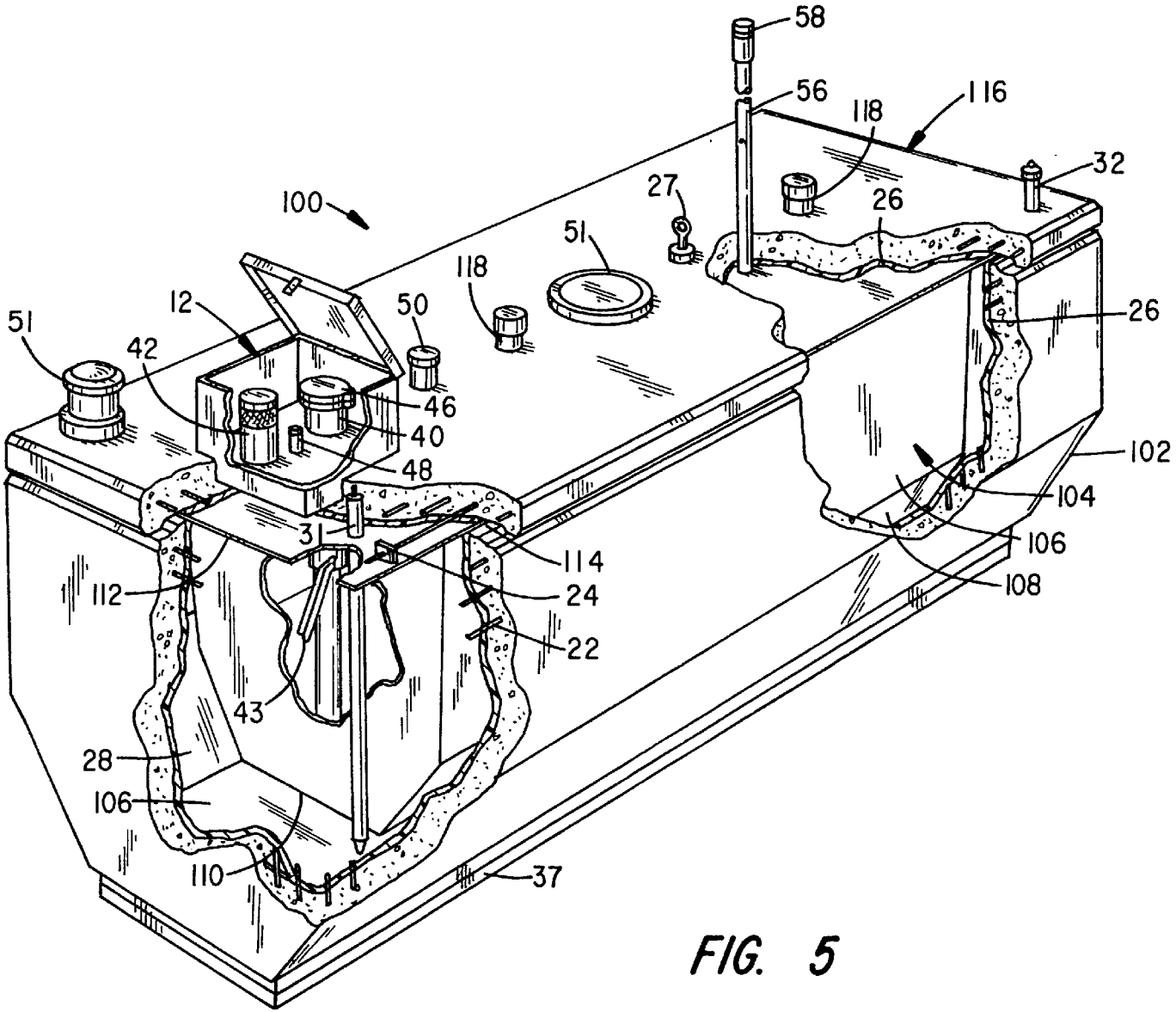
FIG. 5 is a cross section view through an alternative primary tank having welded side and bottom walls.

FIG. 5 shows another vault 100 that is constructed with a base 102 that is fitted with a flat topped primary tank 104. The vault 100 is sized to store liquid volumes on the order of 10 to 20 thousand gallons. Such tanks find application at locations having large volume requirements, such as attended or unattended gasoline dispensing stations.

The base 102 and tank 104 are constructed to complementary shapes with side walls which taper near the bottom of the vault 100. The principal difference between the vault 100 and the vault 2 is that the base 102 is sized to provide extra capacity at a secondary storage space 106.

The tank 104, otherwise, is constructed with a number of welded side and bottom wall panels 106, 108 and 110. A flat top wall 112 extends to overlap a flanged surface 114 at the upper edge of the base 102. A cover 116 is cast in place to the top wall 112. A variety of standpipes 32, 40, 42 and 50 are fitted to the tank 104. Other conduits 31 and 51 communicate with the interior of the base 102. All project from the cover 116, which also supports a spill containment collar 12. Redundant or extra standpipes 118 are also provided at the tank 104. As necessary multiple tanks 104 might be included within the base 102, along with blending pumps and conduits.

With attention to FIG. 6, a fuel dispensing station 120 is shown. The station 120 is constructed of a base 122 and a cover 124 which is integrally cast in place to a round primary tank 126. Projecting from the sides of the tank 126 are a number of support brackets 128 which span the base 122 and mount to rim of the side walls at the base 122. A flat top plate 130 and insulation 26 are fitted over the brackets 128. In lieu of the combination of brackets 128 and plate 130, formed brackets with relatively wide flange webs (e.g. right angled) might be formed of a sheet stock and be fitted to the tank 126 to essentially form a flat plate that spans the base 122.

Supported to the sidewall of the vault 122 is a fuel dispensing assembly 132. The assembly 132 is adapted to include an operator panel 134 having a credit card reader 136 and an operator keyboard 138 and visual displays 140 to facilitate fuel selection and record keeping charges. Necessary support conduits are fitted to the appurtenant standpipes of the tank 104 to accommodate the side wall mounting. Although a spill containment collar 12 is depicted at the cover 124, it might also be fitted to the side wall of the base 122, provided necessary support conduits are fitted to the tank 104 and secondary storage space 106.

Such alternative mountings are desirable with large tanks, where it is preferable that maintenance personnel not have to access the top of the tank 2 with ladders. An exemplary large tank application, where access to the container top is preferably restricted, is at an unattended fuel dispensing tank.

Upright, concrete filled guards 142 are mounted to surround the tank 4 to prevent a vehicle from colliding with the tank 122. A variety of vandalism guards can also be fitted around the periphery of the base 122 to protect the primary tank, the dispensing assembly 132 and other critical tank accessories and fittings. If used as a public dispensing station, the vault might also be buried with only the spill containment collar and/or manhole access cover exposed and protected.

While the invention has been described with respect to alternative constructions and various considered modifications and improvements thereto, still other constructions may be suggested to those skilled in the art. For example, although a metal tank 4 is presently preferred, the cover 25 can readily be adapted into a fiberglass tank. In lieu of using a cast base 8, the base 8 can also be constructed as a brick or block wall or other structure. An auxiliary flange plate of a variety of constructions might also be separately mounted and attached to the primary tank. The invention should be therefore be broadly construed within the spirit and scope of the appended claims.

What is claimed is:

1. Liquid containment apparatus comprising:

(a) a base having a plurality of sidewalls which vertically project from a bottom wall to a circumferential rim to define an open cavity;

(b) tank means having a plurality of walls and a top wall which define a primary storage space for containing a liquid and wherein said top wall is supported to said rim;

(c) means for defining a secondary storage space between said tank means and the walls of said base; and (d) a cover which is aligned to and overlies said top wall and mounts to said rim to cover the open cavity.

2. Apparatus as set forth in claim 1 wherein said tank means includes a fill pipe and further including spill containment means having a housing which surrounds an access port to said fill pipe for capturing spillage from said fill pipe and directing the spillage into said secondary storage space.

3. Apparatus as set forth in claim 2 wherein said spill containment means includes an overflow pipe having an exposed aperture mounted to extend from the housing and through said cover, and drain means coupled to said fill pipe for directing spillage less than a predetermined amount into said fill pipe and spillage entering said exposed aperture into said secondary space.

4. Apparatus as set forth in claim 1 wherein said base includes a liquid impermeable membrane mounted between said tank means and said sidewalls and wherein said membrane defines said secondary storage space and terminates at said rim to contain liquid above said membrane in said secondary storage space in the event of tank leakage.

5. Apparatus as set forth in claim 4 wherein surfaces of said base beneath said impermeable membrane are lined with a thermal insulation and wherein the space between said membrane and the walls of said base define a tertiary storage space.

6. Apparatus as set forth in claim 5 including means for monitoring liquid which collects in said secondary storage space.

7. Apparatus as set forth in claim 1 wherein said cover includes reinforcement means for maintaining the rigidity of said cover, wherein said top wall includes attachment means coupled to said reinforcement means and wherein the reinforcement and attachment means are integrally cast into said cover such that said cover and tank means are permanently aligned and bound to one another and removeable as a unit.

8. Apparatus as set forth in claim 7 wherein said tank means comprises an enclosed metal container.

9. Apparatus as set forth in claim 1 wherein end walls of said tank means vertically taper to center said tank means within the base.

10. Liquid containment apparatus comprising:

(a) a base having a plurality of sidewalls which vertically project from a bottom wall to a circumferential rim to define an open cavity;

(b) tank means having a plurality of walls which define a primary storage space for containing a liquid and wherein support means project from said walls and span the sidewalls of said base to support said tank means to said rim;

(c) means for defining a secondary storage space between said tank means and the walls of said base: and (d) a cover which is aligned to and overlies said top wall and mounts to said rim to cover the open cavity.

11. Apparatus as set forth in claim 10 wherein said cover includes reinforcement means for maintaining the rigidity of said cover, wherein said support means comprises a flat plate secured to said tank means, wherein said plate includes attachment means coupled to said reinforcement means, and wherein the reinforcement and attachment means are integrally cast into said cover such that said cover and tank means are permanently aligned and bound to one another and removeable as a unit.

12. Apparatus as set forth in claim 10 wherein said cover includes reinforcement means for maintaining the rigidity of said cover, wherein said support means includes attachment means coupled to said reinforcement means and wherein the reinforcement and attachment means are integrally cast into said cover such that said cover and tank leans are permanently aligned and bound to one another and removeable as a unit.

13. Apparatus as set forth in claim 12 wherein said support means comprises brackets which project from said tank means and rest on said rim and support.

14. Apparatus as set forth in claim 12 wherein said tank means comprises an enclosed fiberglass container.

15. Apparatus as set forth in claim 12 wherein said tank means comprises an enclosed metal container.

16. Apparatus as set forth in claim 12 wherein said tank means includes a fill pipe and further including spill containment means having a housing which surrounds said fill pipe, an overflow pipe having an exposed aperture mounted to extend from the housing and through said cover, and drain means coupled to said fill pipe for directing spillage less than a predetermined amount into said fill pipe and spillage entering said exposed aperture into said secondary space.

17. Liquid containment apparatus comprising:

(a) a base having a plurality of concrete sidewalls which vertically project from a concrete bottom wall to a circumferential rim to define an open cavity;

(b) tank means having a plurality of walls and a top wall which define a primary storage space for containing a liquid and wherein said top wall spans the sidewalls of said base and includes attachment means;

(c) means for defining a secondary storage space between said tank means and the walls of said base; and (d) a concrete cover wherein said cover includes reinforcement means for maintaining the rigidity of said cover, wherein said reinforcement means are coupled to said attachment means and integrally cast into said cover such that said cover and tank means are permanently aligned and bound to one another and removeable as a unit from said base and whereby upon supporting said top wall to said rim said cover encases the open cavity.

18. Apparatus as set forth in claim 17 wherein said base includes a liquid impermeable membrane mounted between said tank means and said sidewalls and wherein said membrane defines said secondary storage space and terminates at a peripheral edge of said sidewalls to contain liquid above said membrane in said secondary storage space in the event of tank leakage or spillage from said spill means; wherein said tank means includes a fill pipe; and further including spill containment means having a housing which surrounds said fill pipe, an overflow pipe having an exposed aperture mounted to extend from the housing and through said cover, and drain means coupled to said fill pipe for directing spillage less than a predetermined amount into said fill pipe and spillage entering said exposed aperture into said secondary space.

19. Liquid containment apparatus which mounts to a base container having a plurality of sidewalls which vertically project from a bottom wall to a circumferential rim to define an open cavity, comprising tank means having a plurality of walls and a top wall which define a primary storage space for containing a liquid, wherein said top wall includes attachment means, wherein said top wall overlies the rim and supports said tank means to said base wherein reinforcement means are coupled to said attachment means and wherein the coupled reinforcement means and attachment means are cast into a cover that overlies said top wall whereby said cover and tank means are removeable as a unit from said base.

20. Liquid containment apparatus which mounts to a base container having a plurality of sidewalls which vertically project from a bottom wall to a circumferential rim to define an open cavity, comprising tank means having a plurality of walls which define a primary storage space for containing a liquid, wherein flange means are mounted to said tank means and include attachment means, wherein said flange means overly the rim and support said tank means to said base, wherein reinforcement means are coupled to said attachment means and wherein the reinforcement means and attachment means are cast into a cover that overlies said top wall whereby said cover and tank means are removeable as a unit from said base.

21. Apparatus as set forth in claim 20 wherein said flange means comprises a plate having a plurality of holes through which standpipes of said tank means project.

22. Apparatus as set forth in claim 20 wherein said flange means comprises a plurality of brackets which mount to and extend from said tank means.

23. Apparatus as set forth in claim 22 including means mounting to said bracket for supporting a quantity of concrete.

24. A method for forming a liquid storage container comprising:

(a) selecting a base container having a plurality of sidewalls which vertically project from a bottom wall to a circumferential rim to define an open cavity;

(b) supporting a top wall of tank means having a plurality of walls and a top wall which define a primary storage space for containing a liquid to said rim and wherein said top wall spans the sidewalls of said base and includes attachment means; and (c) securing a plurality of reinforcement members to said attachment means;

(d) fitting a plurality of form walls about the perimeter of said top wall;

(e) depositing a quantity of concrete over said top wall to integrally cast said reinforcement and attachment means into a cover, whereby said cover and tank means are permanently aligned and bound to one another and removeable as a unit from said base.

* * * * *